United States Patent [19]

Pasbrig

[11] 4,084,456

[45] Apr. 18, 1978

[54] WRENCH

[76] Inventor: Max Pasbrig, Casa Luce, via Eco, 6644 Orselina, Switzerland

[21] Appl. No.: 534,641

[22] Filed: Dec. 19, 1974

[30] Foreign Application Priority Data

Feb. 1, 1974 Germany ..... 7403522

[51] Int. Cl.[2] ..... B25B 13/00; B25G 1/00

[52] U.S. Cl. ..... 81/177.8; 81/58.5; 81/98; 81/127; 81/125.1

[58] Field of Search ..... 81/58.5, 98, 125.1, 81/127, 177.8, 177.9

[56] References Cited

U.S. PATENT DOCUMENTS

| | | | |
|---|---|---|---|
| 651,574 | 6/1900 | Meredith | 81/125.1 X |
| 1,286,926 | 12/1918 | Brightly | 81/98 |
| 1,363,274 | 12/1920 | Saffold | 81/98 |
| 1,366,224 | 1/1921 | Walsh et al. | 81/98 |
| 1,805,298 | 5/1931 | Schweigert | 81/177.8 |
| 3,290,970 | 12/1966 | DeLucia | 81/177.8 X |
| 3,383,962 | 5/1968 | Harris | 81/177.9 |
| 3,572,190 | 3/1971 | Oeland | 81/127 |
| 3,779,107 | 12/1973 | Avery | 81/177.8 |

FOREIGN PATENT DOCUMENTS

| | | | |
|---|---|---|---|
| 1,958,614 | 3/1971 | Germany | 81/98 |

*Primary Examiner*—James L. Jones, Jr.
*Assistant Examiner*—James G. Smith
*Attorney, Agent, or Firm*—Werner W. Kleeman

[57] ABSTRACT

A wrench for turning components such as bolts, nuts, screws or the like wherein a gripping head is pivotally connected to the wrench handle so that with the head gripping the component to be turned, the handle can be pivoted from a position in which it is generally radial with respect to the axis of turning of the component, to a position in which it is more axial relative to the said axis of turning of the component. The wrench preferably has a second gripping head at the other end, and each gripping head is similarly pivoted to the handle. Each head may be pivotable relative to the handle by 90° to each side of a mean position in which the head is in the general plane of the handle.

10 Claims, 3 Drawing Figures

WRENCH

FIELD OF THE INVENTION

This invention relates to tools, such as spanners and wrenches, which are for turning components such as bolts, screw heads, nuts and the like.

The invention has particular advocation to universal wrenches, that is to say, wrenches having heads which can grip bolts, screw heads, nuts or the like of different sizes.

DISCUSSION OF THE PRIOR ART

Universal wrenches heretofore have comprised an elongated handle having at one or each end, a gripping head. Such gripping head is usually either an extension of and integral with the handle, or is carried by the handle for rotation about an axis perpendicular to the general plane of the gripping head, which is usually generally flat. Some gripping heads are defined by a loop shaped strap; and a gripping nose member which can be pivoted relative to the strip to grip a screw head, nut or the like surrounded by the strap. The gripping nose part may be defined by the end of the handle, or by a member pivotally carried by the handle.

Another known form of head is defined by a pair of jaws which are movable together and apart to suit the size of screw head, nut or the like to be gripped and turned by the tool.

In practice, the known tools to which the invention relates, and in particular universal wrenches, are useless where a screw head, nut or the like is to be gripped and there is little or no lateral clearance for the movement of the handle. This occurs frequently in motor vehicle engines where for example screws, nuts or the like to be turned are disposed in recesses and close to body panelling and casings in the engine compartment.

For example, in the turning of bolts in automobile engines it is frequently the case that conventional wrenches can be positioned to grip the bolt or nut to be turned but, because the handle lies radially of the bolt and only a limited space is available, the handle cannot be swung sufficiently to loosen the bolt or nut. The use of ratchet mechanisms in these wrenches has helped partially to solve this problem but not altogether eliminate it, and there are still cases where many and large other engine parts must be removed, before the correct access can be obtained, for the turning of the component in question. This leads to high labour charges, and because of this automobile designers have had to bear in mind spanner or wrench accessibility in designing motor vehicles, and their engines.

Of course, it is not only in the motor vehicle industries that there are bolts, screws and nuts which require to be turned that are inaccessible. Bolts, screws nuts and the like are used in an infinitely wide number and type of machines and equipment and the tool according to the invention has application in all of these applications.

OBJECT OF THE INVENTION

The present invention has a main object to provide a tool which is usable for the turning of components such as bolts, screws, nuts or the like which are otherwise inaccessible to conventional tools to which the invention relates.

A secondary object of the present invention is to provide a tool having a pivotal head at each end, such heads being interchangeable with each other and with replacement heads.

A further object of the present invention is to provide a tool with a head or heads which is or are of even minimum thickness.

A further object of the present invention is to provide a tool which is effective in gripping and turning components of small height.

A still further object of the present invention is to provide a tool which is simple in construction and easy to use.

SUMMARY OF THE INVENTION

Figures 1, 2, 3:
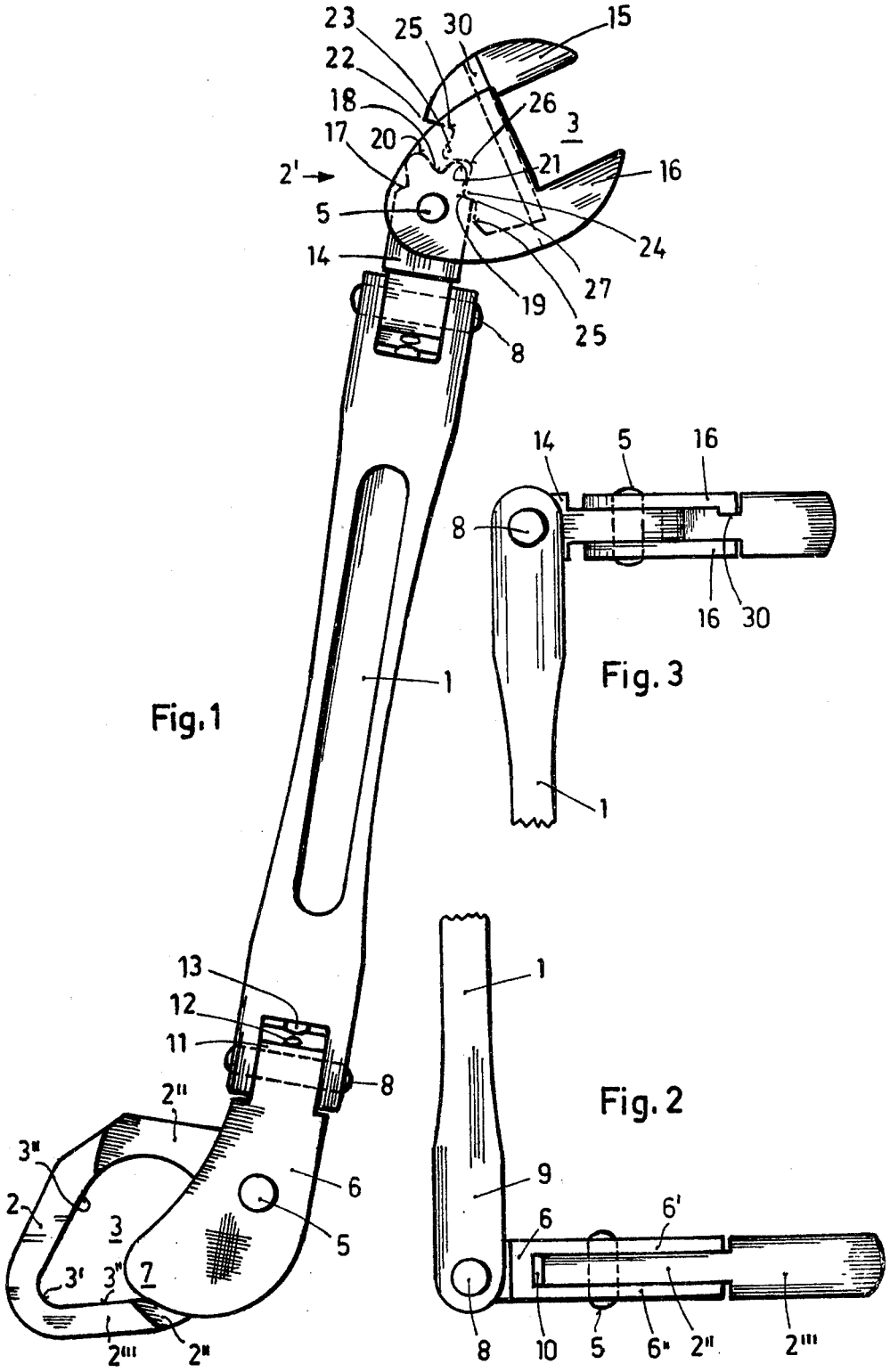
FIG. 1 shows a plan view of a tool according to the present invention.
FIGS. 2 and 3 are side views of the respective ends of the handle of the tool of FIG. 1, showing the heads connected thereto in angularly adjusted positions.

The present invention provides a tool for turning screw heads, nuts and the like comprising an elongated handle having a head at one end thereof. The head is adapted for engagement with a screw head, nut or the like, for the turning of same, and furthermore is pivotally connected to the handle for pivotal movement relative to the handle about an axis. When the head engages the screw head, nut or the like to be turned, the handle can be pivoted relative to the head from a position which is generally radial to a position in which it is more axial with respect to the axis about which the screw head nut or the like is to be turned. This enables the tool to be used in situations where there is minimum radial clearance.

It is preferred that the handle has a second head at the other end thereof, said second head also being for engagement with a screw head, nut or the like, for the turning of same, and further being pivotally connected to the handle for pivotal movement relative to the handle about an axis lying such that, when the head engages the screw head nut, or the like to be turned, the handle can be pivoted relative to the head from a position which is generally radial to a position in which it is more axial with respect to the axis about which the screw head nut or the like is to be turned.

Furthermore, it is preferable that the or each head be pivotable relative to the handle about the said axis by at least 90°, and in a preferred form of the invention each of the heads is associated with its own catch means, whereby the head can be retained by the catch means in any one of several angularly adjusted positions relative to the handle.

Referring now to the drawing, the universal wrench shown in FIG. 1. comprises a handle 1 and two heads 2 and 2'. The respective heads 2 and 2' are of different type as will be obvious from FIG. 1 , and the gripping openings of the head are indicated by numeral 3. Each head is provided with its own pivot axis 5 which is normal to the general plane of the drawing, and the respective heads 2 and 2' have supporting members 6 and 14 which are pivotally connected to the ends of handle 1. These pivot joints with the handle ends are identical, and only one will be described in detail.

Referring to FIG. 2, it will be seen that handle end 9 is forked, and a portion 11 of the supporting member 6 is located between the arms of the fork end 9. A pivot pin 8 passes through the arms of the fork end 9, and also portion 11, whereby the head 2 can be pivoted relative to the handle as far as to the position shown in FIG. 2, in which the head lies in a plane which is at right angles to the plane containing the handle 1. FIG. 3 shows that the head 2′ can be pivoted to a similar position. These heads 2 and 2′ can be pivoted in the opposite direction relative to the handle, again to a 90° position relative to the handle.

Each of the heads as will be seen is generally flat, and the pivot axis defined by pin 8 of the associated head, lies in the general plane of the head 2 and 2′.

Considering now the head 2 in detail, this comprises the supporting member 6, which is in fact a gripping nose member, and this has a slotted portion in the general plane of the head, defining two fork plates or arms 6′ and 6″. Between these arms 6′ and 6″ is located a thin portion 2″ of a gripping strap defining a closed loop 3. This thin portion 2″ is pivoted to the member 6 by means of the pin 5 which passes through the arms 6′ and 6″ and also through the thin part 2″ of the gripping loop. The thickened portion 2‴ of the gripping loop is approximately equal to the overall thickness of the member 6, as will be seen clearly from FIG. 2, and the arms 6′ and 6″ terminate in nose formations 7 which project so as to overlap the loop space 3. These nose projections, in the use of the tool, serve to clamp a screw head, nut or the like to the mutually inclined faces 3″ which partially define the interior contour of the gripping loop, and are joined by a radius surface 3′ which faces the nose formations 7. The surfaces 3″, which are straight, are of unequal lengths, and lie at an acute angle one relative to the other as will be clear from FIG. 1.

In order to hold any one of the heads in an angularly adjusted position relative to the handle 1, at each end of the handle there is provided a spring loaded catch head 13 which serves to engage flattened portioned 12, or flats on the portion 11 of the member 6. Alternative forms of catch arrangements may of course be used if desired.

The heads 2 and 2′ preferably will be detachable and interchangeable with each other, or they may be replaced by wrench heads of different types.

Turning now to consider the head 2′ at the other end of the handle, this is made up of three parts, namely a supporting part 14 defining a member which is pivotally connected to the handle 1 about the pin 8, a first jaw part 16 which is pivotally connected to the supporting part 14 about pin 5, and a second jaw part 15 which together with first jaw part 16 defines the opening 3, and which is slidably carried on the first jaw part 16 by means of appropriate guides and slots 30 on the respective jaw parts. The second jaw part 15 is connected to the supporting part 14 by a ratchet arrangement 17 to 27 whereby, with pivoting movement of the first jaw part 16, the first and second jaw parts 15 and 16 are moved closer together or further apart to maximum limits defined by the physical dimensions of the head.

The ratchet arrangement comprises teeth 20 and 21, and recesses, 17, 18 and 19 between the teeth 20 and 21, on the supporting part 14, which are arranged in a circular arc having its centre on the axis of pin 5, and interspaced teeth 22, 23, 24 and 25 and recesses 26, 27 and 28. The teeth and recesses of the second jaw part and the supporting member interengage to provide the connection.

Although the pivot pins 8 are shown as being in the general planes of the heads 2 and 2′, such pins can be disposed out of these planes, and may lie parallel thereto.

By virtue of the fact that the heads are pivotable to the positions shown in FIGS. 2 and 3, it is possible using the tool to grip and rotate an otherwise inaccessible screw head, nut or the like, and as the heads can be pivoted to either side of the handle, the tool can be used for the tightening of such screw heads and nuts or the like, or for the loosening of same. By suitable adaptation of the heads, it is possible that the spring loaded catches 13 can hold the heads in positions of angularity relative to the handle 1 which are other than the 90° positions shown.

In a modification, instead of the head 2 having a gripping strap of the configuration shown, such strap may have an opening which is in the form of an irregular hexagon of which the sides opposite the nose formations 7 are smaller than the other sides of the hexagon. In particular, such smaller sides may be approximately half of the length of the largest side of the hexagon, and the sides may lie at an angle of 60° with one another.

There is an advantage in providing the gripping strap in thick and thin sections as shown, in that the outer faces of the thick portion lie basically in the planes of the outer faces of the arms 6′ and 6″ of the supporting member 6. This enables the head to have an even thickness, and by providing the arms 6′ and 6″, screw heads, nuts and the like which have only a small height can be gripped effectively, even if only one of the nose formations 7 clamps such screw head, nut or the like against the gripping strap.

It is to be appreciated that the head 2, by virtue of the fact that the faces 3′ lie at an angle and define a wedge recess, can be used for the gripping of members other than hexagonal sectioned members.

The invention is not to be considered limited to the universal wrench as shown. The novelty of the invention in providing a pivot axle whereby the handle can be moved from a radial position relative to the member being turned by the tool, to a more axial position, can be embodied in other tools or universal wrenches embodying different forms of gripping head.

What we claim is:

1. A tool for turning components comprising an elongated handle, a head provided at one end of said handle, said head being adapted for engagement with a component for the turning of said component, a member engageable with said head and said handle, means for pivotably mounting said member at said handle for movement about a pivot axis lying in a plane extending substantially at right angles to a plane extending lengthwise of said handle and substantially at right angles to said handle, means for pivotably mounting said head at said member for movement about a pivot axis extending substantially perpendicular to said member, said head being pivotably connected to the handle for pivotable movement relative to the handle about an axis lying such that when the head engages the component to be turned the handle can be pivoted relative to the head from a position which is generally radial to a position in which it is more axial with respect to the axis about which the component is to be turned, and means cooperating with said head for automatically opening and closing the effective size of said head engageable with said component as a function of the movement of said handle, said head including a gripping strap in the form of a closed loop to be located about a component to be gripped, said cooperating means including nose formation means pivotable relative to said gripping strap for gripping the component between the gripping strap and the nose formation means of said gripping nose member, said gripping nose member having a forked portion including arms, said gripping strap being generally flat and having shoulders defining a thin portion and a thick portion, said thin portion being pivotably mounted between the arms of said forked portion, said thick portion being of substantially the same thickness as the forked portion of said gripping nose member which is also generally flat.

2. A tool according to claim 1, wherein the internal shape of the loop defined by the gripping strap is partially defined by two faces of a different length and lying at an acute angle to one another, said faces meeting at a region which lies opposite to the nose formation means of the gripping nose member.

3. A tool according to claim 1, wherein the said head is pivotable relative to the handle by up to approximately 90°.

4. A tool according to claim 3, wherein said head can be held in any one of a number of angularly adjusted positions relative to the handle by catch means associated with the said head.

5. A tool according to claim 4, wherein the catch means includes a spring loaded catch member.

6. A wrench according to claim 1, wherein said head is detachable from the handle by means of said pivotably mounting means thereof.

7. A tool for turning components comprising an elongated handle, a head provided at one end of said handle, said head being adapted for engagement with a component for the turning of said component, a member engageable with said head and said handle, means for pivotably mounting said member at said handle for movement about a pivot axis lying in a plane extending substantially at right angles to a plane extending lengthwise of said handle and substantially at right angles to said handle, means for pivotably mounting said head at said member for movement about a pivot axis extending substantially perpendicular to said member, said head being pivotably connected to the handle for pivotable movement relative to the handle about an axis lying such that when the head engages the component to be turned the handle can be pivoted relative to the head from a position which is generally radial to a position in which it is more axial with respect to the axis about which the component is to be turned, and means cooperating with said head for automatically opening and closing the effective size of said head engageable with said component as a function of the movement of said handle, said handle having a second head at the other end thereof, said second head also being for engagement with a component for the turning of same, and means for pivotally mounting said second head to the handle for pivotal movement relative to the handle about an axis lying such that, when the head engages the component ponent to be turned, the handle can be pivoted relative to the head from a position which is generally radial to a position in which it is more axial with respect to the axis about which the component is to be turned, said second head being pivotable relative to the handle up to approximately 90°, and catch means associated with said second head for holding said second head in any one of a number of angularly adjusted positions relative to the handle, said catch means including a spring-loaded catch member.

8. A tool according to claim 7, wherein the second head defines an open ended spanner head in three parts comprising a supporting part which is pivotally connected to the handle, a first jaw part which is pivotally connected to the supporting part, and a second jaw part defining with the first jaw part a spanner opening, said second jaw part being connected to the supporting part by a rack teeth arrangement defining said cooperating means so that relative pivoting of the first jaw part on the supporting part effects moving together or apart of the faces of the first and second jaw parts defining the spanner opening.

9. A tool according to claim 8, wherein the second jaw part has teeth defining a straight rack, and the supporting part has teeth defining a curved rack having its centre on the axis of rotation between the first jaw part and the supporting part.

10. A tool according to claim 7, wherein said head and second head are detachable from the handle and are interchangeable by means of said pivotably mounting means thereof.

* * * * *